US012324551B2

(12) United States Patent
De Wit et al.

(10) Patent No.: US 12,324,551 B2
(45) Date of Patent: Jun. 10, 2025

(54) CLEANING DEVICE

(71) Applicant: KONINKLIJKE PHILIPS N.V., Eindhoven (NL)

(72) Inventors: Bastiaan Johannes De Wit, Nuis (NL); Matthijs Hendrikus Lubbers, Lieveren (NL); Pieter Kingma, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 140 days.

(21) Appl. No.: 17/179,523

(22) Filed: Feb. 19, 2021

(65) Prior Publication Data

US 2021/0169292 A1 Jun. 10, 2021

Related U.S. Application Data

(62) Division of application No. 16/487,202, filed as application No. PCT/EP2018/053372 on Feb. 12, 2018, now Pat. No. 12,048,401.

(30) Foreign Application Priority Data

Feb. 27, 2017 (EP) ..... 17158036

(51) Int. Cl.
*A47L 11/20* (2006.01)
*A47L 7/00* (2006.01)
(Continued)

(52) U.S. Cl.
CPC ..... *A47L 11/201* (2013.01); *A47L 7/009* (2013.01); *A47L 9/0686* (2013.01); *A47L 11/30* (2013.01);
(Continued)

(58) Field of Classification Search
CPC ..... A47L 11/201; A47L 11/4044; A47L 11/4083; A47L 11/4088; A47L 11/4094;
(Continued)

(56) References Cited

U.S. PATENT DOCUMENTS 1,376,195 A 4/1921 Alphonse
4,270,238 A * 6/1981 Shallenberg ..... A47L 11/4075 15/322
(Continued)

FOREIGN PATENT DOCUMENTS

CN 1038438 A 1/1990
CN 2294019 Y 10/1998
(Continued)

OTHER PUBLICATIONS

PE2E Translation DE-202005008171; Raffay & Fleck; Sep. 8, 2005; p. 1-3 (Year: 2005).*
(Continued)

*Primary Examiner* — Tom Rodgers
*Assistant Examiner* — Sidney D Full
(74) *Attorney, Agent, or Firm* — Maschoff Brennan

(57) ABSTRACT

A cleaning device comprises a surface interaction layer (ML), a cleaning fluid supply (CFF) provided with a cleaning fluid channel (CFC) at the surface interaction layer (ML) for supplying a cleaning fluid to a surface (F) through the surface interaction layer (ML) being in contact with the surface (F), and a dirty fluid drain (DFD) having a dirty fluid channel (DFC) at the surface interaction layer (ML) for draining, by means of underpressure, dirty water from the surface (F) through the surface interaction layer (ML) being in contact with the surface (F).

11 Claims, 4 Drawing Sheets

(51) Int. Cl.
*A47L 9/06* (2006.01)
*A47L 11/30* (2006.01)
*A47L 11/40* (2006.01)

(52) U.S. Cl.
CPC ..... *A47L 11/4044* (2013.01); *A47L 11/4083* (2013.01); *A47L 11/4088* (2013.01); *A47L 11/4094* (2013.01)

(58) Field of Classification Search
CPC ..... A47L 7/009; A47L 9/0686; A47L 11/00; A47L 11/02; A47L 11/03; A47L 11/20; A47L 11/202–2065; A47L 11/28–30; A47L 13/258; A47L 9/066; A47L 9/068
See application file for complete search history.

(56) References Cited

U.S. PATENT DOCUMENTS

| | | | | |
|---|---|---|---|---|
| 5,735,017 | A * | 4/1998 | Barnes | A47L 11/4027 15/328 |
| 6,279,196 | B2 | 8/2001 | Kasen | |
| 6,735,812 | B2 * | 5/2004 | Hekman | A47L 11/4016 15/384 |
| 7,811,022 | B2 | 10/2010 | Bobrosky et al. | |
| 9,326,651 | B2 * | 5/2016 | Alshehri | A47L 5/14 |
| 10,161,154 | B2 * | 12/2018 | Renaud | E04H 4/1654 |
| 2002/0116784 | A1 * | 8/2002 | Sumner | A47L 11/03 15/322 |
| 2003/0200991 | A1 * | 10/2003 | Keck | A47L 13/20 15/228 |
| 2004/0148721 | A1 * | 8/2004 | Spaulding | A46B 7/04 15/118 |
| 2005/0132523 | A1 * | 6/2005 | Kegg | A47L 11/4075 15/320 |
| 2007/0020020 | A1 | 1/2007 | Bobrosky | |
| 2010/0199455 | A1 | 8/2010 | Vrdoljak | |
| 2010/0236018 | A1 | 9/2010 | Vrdoljak | |
| 2011/0131753 | A1 * | 6/2011 | Krebs | A47L 11/4036 15/320 |
| 2014/0291330 | A1 | 10/2014 | Crocker | |
| 2016/0213214 | A1 | 7/2016 | Lubbers | |

FOREIGN PATENT DOCUMENTS

| | | | | | |
|---|---|---|---|---|---|
| CN | 2331171 | Y | | 8/1999 | |
| CN | 1353073 | A | | 6/2002 | |
| CN | 2604147 | Y | | 2/2004 | |
| CN | 1535122 | A | | 10/2004 | |
| CN | 1599849 | A | | 3/2005 | |
| CN | 201208131 | Y | | 3/2009 | |
| CN | 103188984 | A | | 7/2013 | |
| CN | 103547202 | A | | 1/2014 | |
| CN | 203408316 | U | | 1/2014 | |
| CN | 203417795 | U | | 2/2014 | |
| CN | 203985718 | U | | 12/2014 | |
| CN | 104550125 | A | | 4/2015 | |
| CN | 204520539 | U | | 8/2015 | |
| CN | 204931569 | U | | 1/2016 | |
| CN | 105581727 | | | 5/2016 | |
| CN | 105686771 | A | | 6/2016 | |
| CN | 105839750 | A | | 8/2016 | |
| CN | 205458489 | U | | 8/2016 | |
| CN | 106073352 | A | | 11/2016 | |
| DE | 2033588 | | | 1/1972 | |
| DE | 2649993 | | | 5/1978 | |
| DE | 202005008171 | | * | 9/2005 | A47L 13/16 |
| DE | 102013108905 | | | 2/2015 | |
| EP | 1795107 | | | 6/2007 | |
| GB | 190423852 | A | | 1/1905 | |
| JP | H0994203 | A | | 4/1997 | |
| JP | 2006136502 | A | * | 6/2006 | |
| RU | 2345699 | C2 | | 2/2009 | |
| WO | 2001060698 | A2 | | 8/2001 | |
| WO | WO-0154555 | A1 | * | 8/2001 | A47L 11/30 |
| WO | 2007/111934 | | | 10/2007 | |
| WO | 2008030396 | | | 3/2008 | |
| WO | 2010093446 | A1 | | 8/2010 | |
| WO | 2016/008773 | | | 1/2016 | |
| WO | 2016/062649 | | | 4/2016 | |
| WO | WO-2016191627 | A1 | * | 12/2016 | A47L 13/22 |

OTHER PUBLICATIONS

PE2E Translation JP-2006136502-A; Hirahara, Y; Floor Brush for Vacuum Cleaner and Vacuum Cleaner; Jun. 1, 2006 (Year: 2006).*
PE2E Translation WO-0154555-A1; Diehl, R; Cleaning Head for a Floor-Cleaning Device; Aug. 2, 2001 (Year: 2001).*
PE2E Translation WO 2016191627; Vrdoljak, Ognjen; Surface Treatment Apparatuses and Methods; Dec. 1, 2016 (Year: 2016).*
International Search Report and Written Opinion Dated Jul. 6, 2018 For International Application No. PCT/EP2018/053372, Filed Feb. 12, 2018.
https://en.wikipedia.org/wiki/Chamois_leather.
The Momba Professional microfiber, 2010 Chamlon BV. http://www.mombapro.nl/microvezel-kennis/momba-microvezels.html.

* cited by examiner

CLEANING DEVICE

CROSS REFERENCE TO RELATED APPLICATIONS

This application is a Divisional of U.S. patent application Ser. No. 16/487,202 filed Aug. 20, 2019, which is the U.S. National Phase application under 35 U.S.C. § 371 of International Application No. PCT/EP2018/053372 filed Feb. 12, 2018, published as WO 2018/153706 on Aug. 30, 2018, which claims the benefit of European Patent Application Number 17158036.8 filed Feb. 27, 2017. These applications are hereby incorporated by reference herein.

FIELD OF THE INVENTION

The invention relates to a cleaning device for e.g. floors or windows.

BACKGROUND OF THE INVENTION

US 2010/0199455 discloses a steam appliance having a water reservoir, water pump and steam generator with a vacuum function. The steam appliance has a water pump for selectively injecting water from a reservoir to a boiler to generate steam fed into a steam pocket frame with a fabric steam pocket mounted thereon. In one configuration, when steam is being generated, the vacuum function cannot be used. In another configuration, when the vacuum function is on, the heating element in the steam generator is power at reduced power to reduce power consumption and keep the steam generator heated in stand-by mode and water is not pumped.

US 2010/0236018 discloses a cleaning appliance capable of performing two or more cleaning functions. The cleaning appliance may include a vacuum cleaner and a steam cleaner such that a user can vacuum a floor prior to steam cleaning the floor. Various manual switching arrangements may be used as part of controlling the cleaning appliance. When debris removal and steam cleaning are provided on a single cleaning appliance, simultaneous operation of both functions may be undesirable because in some cases moisture could travel into an air flow conduit or a dirt collector and form grime or mud with the collected debris. The resulting mess could reduce the effectiveness and convenience of the appliance.

US 2016/0213214 discloses a surface cleaning device, comprising a cloth placed on a porous material, a reservoir for collecting liquid absorbed by the cloth, and an arrangement for applying under-pressure in the reservoir so as to transfer liquid from the cloth into the reservoir.

WO 2007/111934 discloses a cleaning implement of the all-in-one type. It has a substrate structure that delivers impregnated cleaning liquid to the window being cleaned, a squeegee to drive used cleaning liquid off the window, and an absorbent to collect the used liquid (via an inset). A single block of substrate structure can provide the applicator, scrubbing, and collecting functions, as well as filter and reprocess used cleaning liquid for further use.

DE 2649993 discloses a window cleaning appliance includes a manually guided hollow cleaning strip which has one or two rubber wipers. It has a compression and suction pipe by means of which water can be electrically pumped up onto the window pane and then drawn off together with the dirt. The cleaning strip can be provided on its side facing the window with a water-permeable strip which extends over the entire width but has variable spacing from the front edge of the rubber wiper. This allows the water to be applied to the window pane and then distributed by means of the water-permeable strip. Thereafter, when water is drained from the window, the water-permeable strip is retracted as a result of the applied suction power, and water is removed from the window by means of the rubber wipers, and the collected water is sucked into a used water tank. It is possible to use one pipe for supplying and draining off the water or to provide a single pipe for each purpose.

SUMMARY OF THE INVENTION

It is, inter alia, an object of the invention to provide an improved cleaning device. The invention is defined by the independent claims. Advantageous embodiments are defined in the dependent claims.

By providing a surface interaction layer with a cleaning fluid supply and a dirty fluid drain, a very compact arrangement can be obtained. As cleaning fluid is supplied to the surface interaction layer, and as dirty fluid is drained from the surface interaction layer by means of underpressure, the surface interaction layer can be relatively thin as it does not need to have a fluid storage capacity, and it is not necessary to regularly dip the cleaning device into a bucket to apply cleaning fluid to the surface interaction layer and to remove dirty fluid from the surface interaction layer. An embodiment having dirty fluid contained separately from cleaning fluid provides the advantage that the surface is always cleaned with clean fluid as opposed to a fluid containing an increasing amount dirt already picked up from the surface. The surface interaction layer could be of a kind (e.g. a cloth) suitable for e.g. mopping the surface.

The surface interaction layer of the present invention is used for both supplying the cleaning fluid to the surface, and draining the dirty fluid from the surface. Transporting a cleaning fluid through the surface interaction layer indeed seems the best execution for rinsing the surface interaction layer during cleaning. In contrast, the device of US 2016/0213214 is solely used for collecting liquid, while in WO 2007/111934 only the cleaning fluid delivering part of the substrate touches the window while fluid is removed from the window by means of the squeegee, with the substrate having an inset (i.e. a part that does not touch the window) to collect the water that has been wiped of the window by the squeegee, while the water-permeable strip of DE 2649993 is solely used for supplying water, and retracted when used water is wiped from the window, in which latter situation only the wipers touch the window.

These and other aspects of the invention will be apparent from and elucidated with reference to the embodiments described hereinafter.

DESCRIPTION OF EMBODIMENTS

Figure 1A:
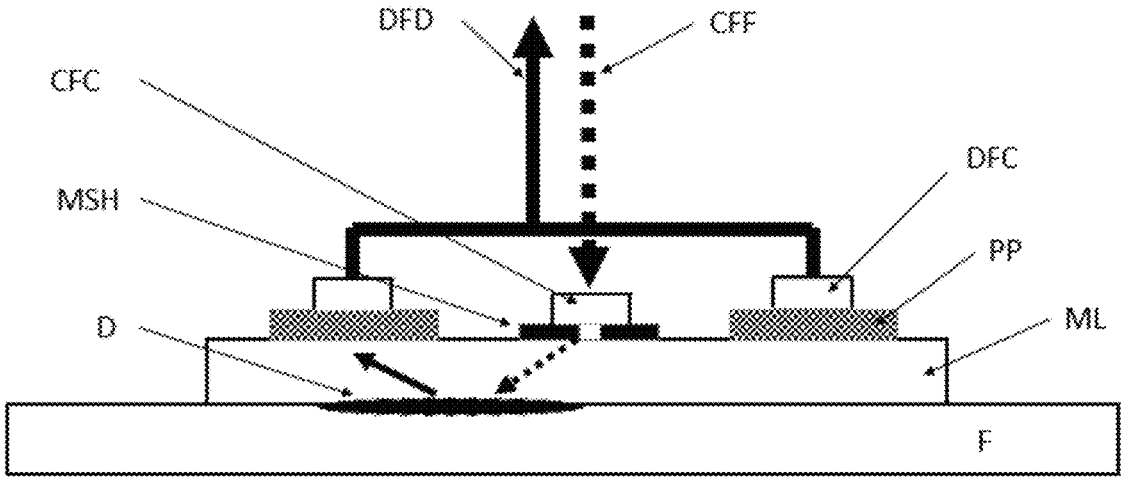
FIG. 1A shows a side view of first embodiment of a cleaning device in accordance with the present invention.

FIG. 1A shows a surface (e.g. a floor) F with dirt D, and on top thereof a side view of a first embodiment of a cleaning device in accordance with the present invention.

Figure 4:
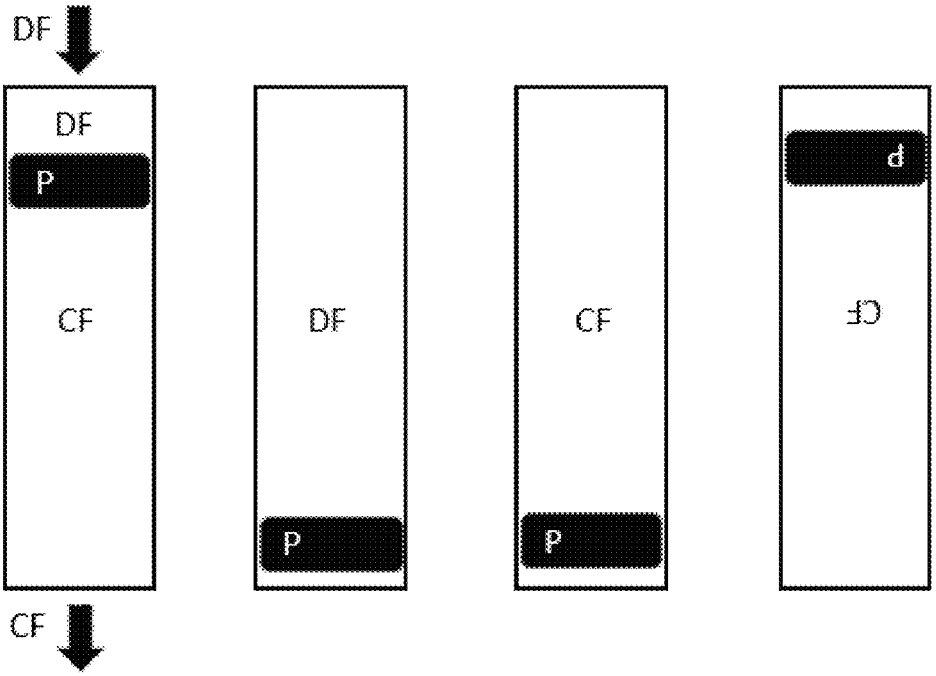
FIGS. 4 and 5 illustrate ways of using a single fluid container for separately containing the cleaning fluid and the dirty fluid.
Figure 5:
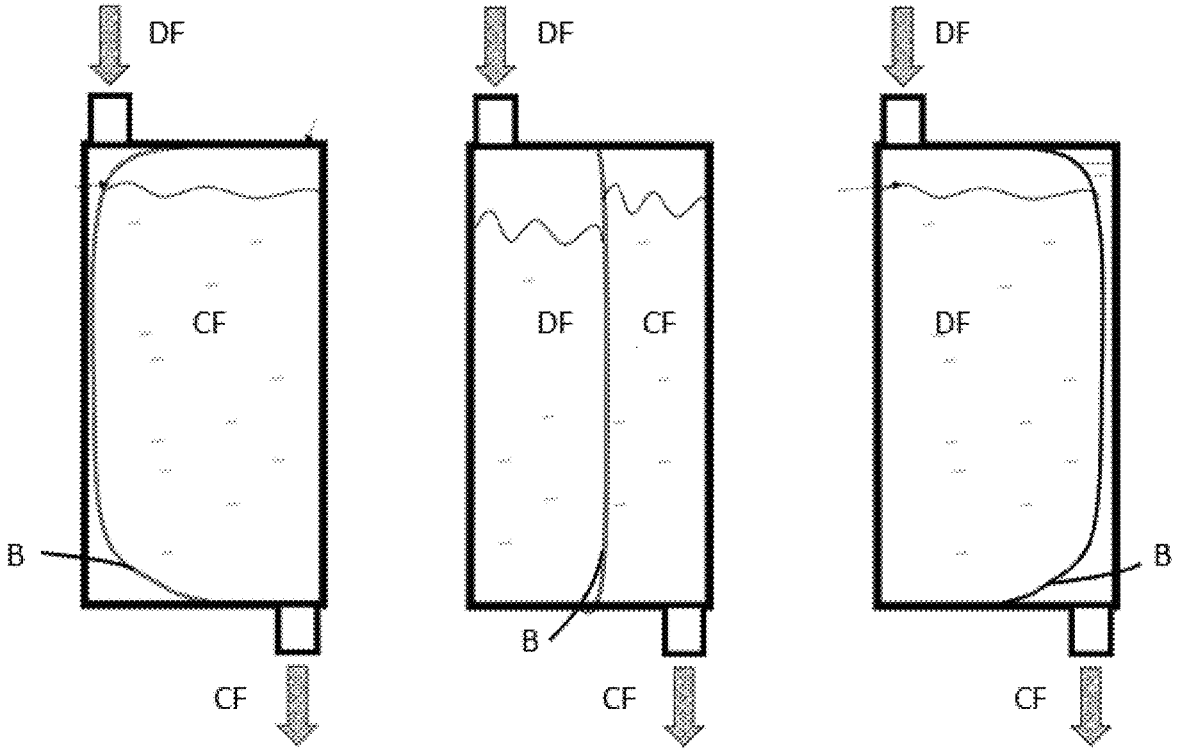

A cleaning fluid (e.g. water and/or a detergent) is supplied to a surface interaction layer ML by means of a cleaning fluid feed CFF (shown by means of a dotted line) from a cleaning fluid container (e.g. as shown in FIG. 4 or 5, or a separate cleaning fluid container) to a cleaning fluid channel CFC on top of a metal sheet with holes MSH at the surface interaction layer ML. If gravity alone does not suffice to supply the cleaning fluid, an optional electrical (e.g. battery-operated) or manual pump may be used to pump the cleaning fluid from the cleaning fluid container or to pump air into the cleaning fluid container so as to push the cleaning fluid out of the container and into the surface interaction layer ML. Reference is made to WO 2016/062649, incorporated herein by reference, for suitable components (especially the metal strip with holes) for supplying the cleaning fluid.

Dirty fluid is drained from the surface interaction layer ML by means of a dirty fluid channel DFC at the surface interaction layer ML. In one embodiment, the dirty fluid channel DFC may be provided with a porous plastic layer PP to retrieve the dirty fluid. The dirty fluid channel DFC is connected via a dirty fluid drain DFD to a dirty fluid container (e.g. as shown in FIG. 4, or a separate dirty fluid container). An electrical (e.g. battery-operated) or manual pump may be used to pump the dirty fluid into the dirty fluid container or to pump air from the dirty fluid container to create an underpressure in the dirty fluid container. Doing so would allow for continuously draining while the surface is cleaned. Reference is made to US 2016/0213214, incorporated herein by reference, for suitable components for draining the dirty fluid.

The surface interaction layer ML, the cleaning fluid channel CFC, and the dirty fluid channel DFC may all have a longitudinal shape of which FIG. 1A shows a side view.

The cleaning device of FIG. 1A could take the form of a stick-based device, in which the containers for the cleaning fluid and the dirty fluid are mounted on or part of the stick, together with any necessary pumps. Alternative, the containers and the pumps could be located just above the surface interaction layer, in which case the surface interaction structure will be thicker, but the stick will be free of liquid containers.

If the cleaning device of FIG. 1A is moved to the right, the cleaning fluid applied by the cleaning fluid channel CFC at the center will help releasing dirt D from the surface F, while the dirty fluid will be drained by the dirty fluid drain unit DFC at the left-hand end of the cleaning device. If the cleaning device of FIG. 1A is moved to the left, the cleaning fluid applied by the cleaning fluid channel CFC at the center will help releasing dirt, while the dirty fluid will be drained by the dirty fluid channel DFC at the right-hand end of the cleaning device.

In a preferred embodiment, the surface interaction layer ML is made of a material that in itself ensures that water is extracted, and in that case, the porous plastic layer PP below the dirty fluid channel DFC can be left out. Cloth that—when wetted—is best able to maintain underpressure in the dirty fluid channel DFC as caused by e.g. a dirty fluid pump appears to be most suitable for draining dirty fluid from the surface F. If pores in the wet cloth as mounted on the cleaning device are too large, the underpressure caused by the dirty fluid pump leakes too easily away, leaving insufficient suction power for draining dirty fluid from the surface F. Suitable materials for the surface interaction layer ML appear to be deerskin or artificial microfiber deerskin. For an overview on chamois leather, also suitable, see en.wikipedia.org/wiki/Chamois_leather. In tests, natural chamois (e.g. marketed as "Handyclean natuurzeem") or microfiber chamois, appeared to be suitable materials. A very suitable product appeared to be Momba professional cleaning cloths, using microfibers covered with polyurethane, as mentioned on www.mombapro.nl/microvezel-kennis/momba-microvezels.html. A very fine sponge-like material may also have suitable properties for serving as a surface interaction layer ML that may be used for mopping surfaces like a floor or a window.

The dirty fluid channel DFC could be provided with e.g. a metal netting having holes of e.g. 1 mm diameter to support the surface interaction layer ML and to prevent it from being sucked into the cleaning device as a result of the underpressure applied to drain the dirty fluid. Alternatively, an array of plastic pillars could be used to support the surface interaction layer ML.

Figure 1B:
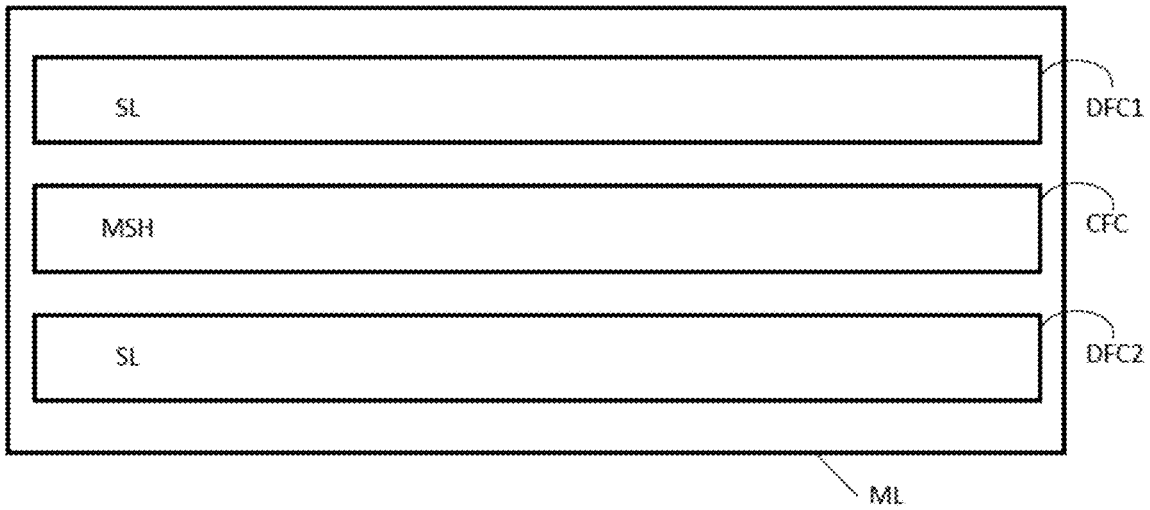
FIGS. 1B, 1C show alternative bottom views of the first embodiment.

FIG. 1B shows a first alternative bottom view of the embodiment of FIG. 1A, with the cleaning fluid channel CFC and dirty fluid channels DFC1-2 being parallel to each other along a z-axis perpendicular to the two dimensions shown in FIG. 1A. The dirty fluid channels DFC1-2 are provided with a support layer SL which could be any of the above-described porous plastic layer PP, the metal netting, or the plurality of pillars.

Figure 1C:
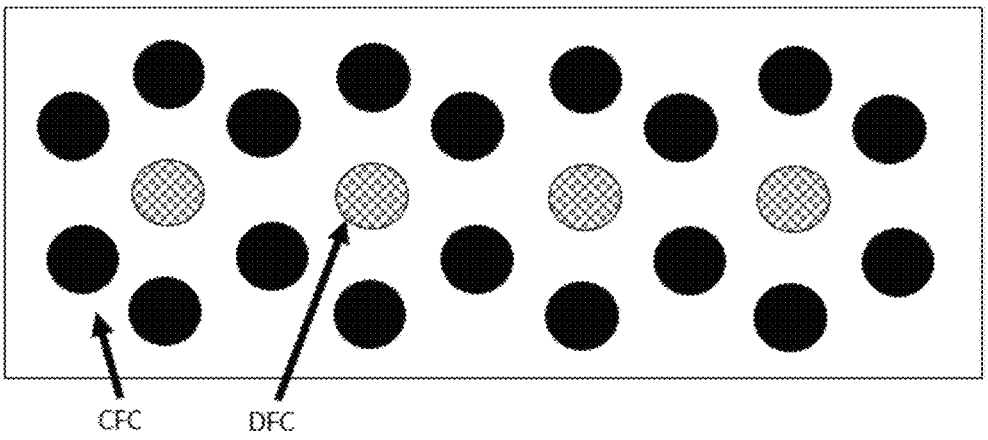

FIG. 1C shows a second alternative bottom view of the embodiment of FIG. 1A, with the cleaning fluid channel CFC and the dirty fluid channel DFC each being formed by a plurality of holes rather than by elongated channels as in FIG. 1B.

Figure 2A:
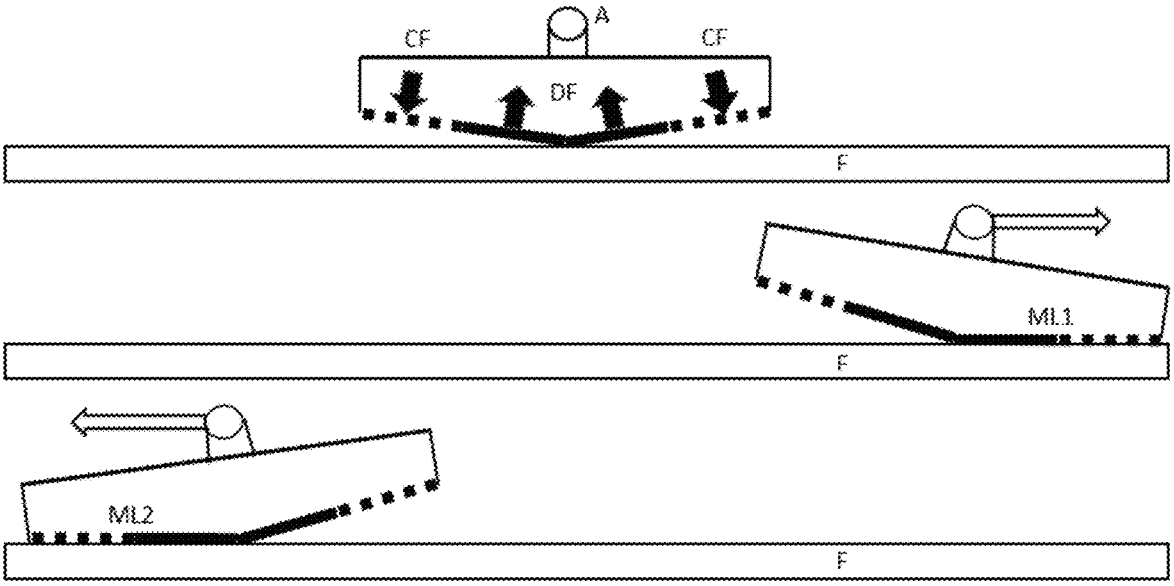
FIGS. 2A, 2B show a second embodiment of a cleaning device in accordance with the present invention.
Figure 2B:
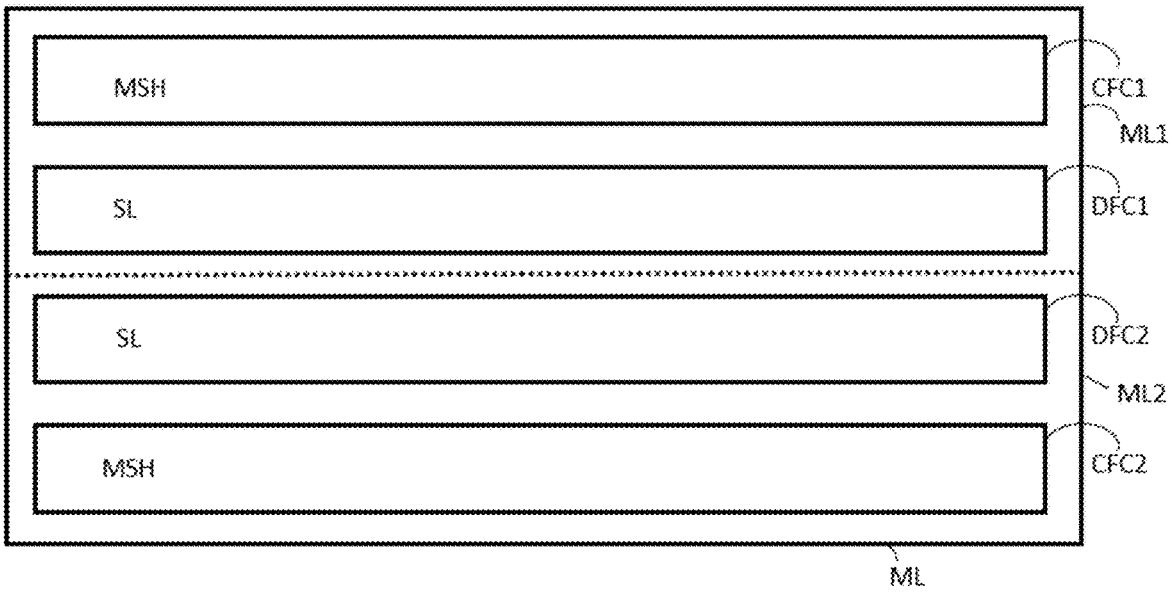

FIGS. 2A, 2B show a second embodiment of a cleaning device in accordance with the present invention. This embodiment is based on the recognition that when the cleaning device of FIG. 1A is moved to the right, dirt on the surface F may stick to the right-hand end of the surface interaction layer ML without being wetted by the cleaning fluid channel CFC at the center and drained at the left-hand end of the surface interaction layer ML by the dirty fluid channel DFC. If thereafter, the cleaning device of FIG. 1 is moved to the left, this dirt collected at the right-hand end of the surface interaction layer ML may be spread over the surface F again, leading to a less than optimal cleaning result. The same may happen when the cleaning device of FIG. 1 is moved to the left: dirt on the surface F may stick to the left-hand end of the surface interaction layer ML, and released to the surface F when the cleaning device of FIG. 1A is moved to the right again.

In view thereof, the embodiment of FIGS. 2A, 2B does not have a flat bottom, but a triangular one, so that in each movement direction one half (either ML1 or ML2, not both) of the bottom ensures that the surface F is first wetted, and thereafter the dirt can be drained. Obviously, where the rather schematic FIG. 2A shows a clear triangular shape with a sharp edge in the middle, in practice a more rounded shape may be present. Also, as regards the angle between the two halves ML1, ML2, what matters is that the angle is such that during movement only one half (either ML1 or ML2, not both) of the bottom interacts with the surface F.

The top section of FIG. 2A shows the principle of the second embodiment of a cleaning device. The cleaning fluid CF is supplied at the left-hand and right-hand sides shown with interrupted lines, while the dirty fluid DF is drained at the two sections in the middle shown with straight lines. For each of these 4 sections, the technical implementation could be the same as that described above with reference to FIG. 1. Another difference with FIG. 1 is that the cleaning device of FIG. 2A can be tilted, as it is mounted by means of an axis A.

The middle section of FIG. 2A shows what happens if the device is moved to the right. As a matter of course, this movement with result in that the right-hand half ML1 of the triangular bottom will touch the surface F, which ensures that the surface F is first wetted by means of the cleaning fluid CF, and thereafter the dirty fluid DF is drained.

A similar effect occurs if the cleaning device is moved to the left, as shown in the bottom section of FIG. 2A. As a matter of course, this movement with result in that the left-hand half ML2 of the triangular bottom will touch the surface F, which again ensures that the surface F is first wetted by means of the cleaning fluid CF, and thereafter the dirty fluid is drained.

Because in both movement directions, the wetting part (shown with interrupted lines) of the cleaning device comes in contact with dirt first, such dirt will be merged with the cleaning fluid CF and the resulting dirty fluid DF will be absorbed, and less dirt will remain stuck to the surface interaction layer. As a result, the cleaning result of the FIG. 2 embodiment will be even better than that of the FIG. 1 embodiment.

FIG. 2B shows a bottom view of the embodiment of FIG. 2A. In FIG. 2B, the dotted line represents the transition between the halves ML1, ML2 of the surface interaction layer ML. The cleaning fluid channels CFC1, CFC2 are at the outer ends, and the dirty fluid channels DFC1, DFC2 are in the middle, close to the transition between the halves ML1, ML2 represented by the dotted line. In an embodiment, the dirty fluid channels DFC1, DFC2 may be formed by a single dirty fluid channel bridging the transition.

Figure 3:
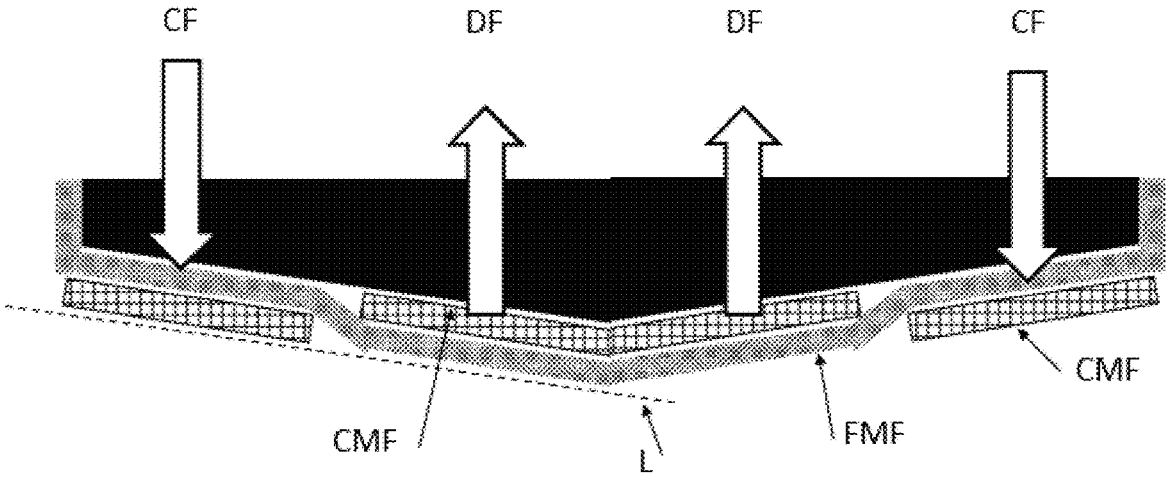
FIG. 3 shows a third embodiment of a cleaning device in accordance with the present invention.

FIG. 3 shows a third embodiment of a cleaning device in accordance with the present invention, which is based on the embodiment of FIG. 2. In the embodiment of FIG. 3, the surface interaction layer ML comprises two alternating sublayers, viz. a fine microfiber FMF, able to create underpressure and dry the surface F optimally, and a coarse microfiber CMF. In the center, the coarse microfiber CMF is used as filler to make the overall surface interaction layer ML more flexible and better able to follow surface unevennesses than if only fine microfiber FMF were used. The line L shows that the overall surface interaction layer surface is substantially straight, although it consists of different segments. For optimal functionality, it is important that there are as few leaks as possible in the surface interaction layer ML. For that reason, in the embodiment of FIG. 3, the total surface interaction layer ML comprises one piece of chamois FMF. The outer edges, where the cleaning fluid is supplied by means of a cleaning fluid supply unit (not shown in FIG. 3), are provided with more coarse microfiber CMF, which is able to capture some coarse dirt like sand. Coarse microfiber has the tendency to be quite soft, enabling it to follow unevenesses in the surface F. As the fine microfiber FMF chamois is much more firm, the coarse microfiber CMF can compensate for that. To compensate for the height difference that the outer coarse microfiber CMF makes, some coarse microfiber CMF is also placed under the fine microfiber FMF chamois at the center where the dirty fluid DF is drained by means of a dirty fluid drain unit (not shown in FIG. 3). In this way, the fine microfiber FMF mopping chamois will still dry the surface F as before, but the overall surface interaction layer ML is softer as a result of the coarse microfiber CMF segments, enabling the surface interaction layer ML to follow the surface's unevenness. Where the coarse microfiber CMF is just used as a filling layer, i.e. where the dirty fluid is drained, it may be replaced by other suitable filling materials that allow the dirty fluid to pass. Where FIG. 3 shows that there is a continuous fine microfiber FMF layer, it is alternatively possible to have 3 separate segments (so, a discontinuity at the places where FIG. 3 shows that the layers CMF and FMF cross each other), provided that then the fine microfiber layer FMF has an airtight connection to the black mopping body as otherwise dirty fluid cannot be sucked from the surface as underpressure caused by e.g. a dirty fluid pump would just leak away.

FIG. 4 illustrates a first way of using a single fluid container for separately containing the cleaning fluid CF and the dirty fluid DF. Doing so is desirable as it allows the device to be slim as only one single container is needed instead of two containers. In use, as shown in the left-most picture of FIG. 4, cleaning fluid CF is supplied from the bottom of the fluid container, while dirty fluid is put into the container at the top e.g. by means of a dirty fluid pump (not shown). Between the two sections is a piston P that moves down when cleaning fluid CF is supplied from the fluid container. As shown in the second picture of FIG. 4, when all cleaning fluid CF in the fluid container has been supplied from the fluid container, the piston P is at the bottom, and on top of the piston P is dirty fluid DF. The dirty fluid DF is then poured out of the container, and cleaning fluid CF is then put into the container, on top of the piston P, as shown in the third picture of FIG. 4. Finally, as shown in the right-most picture of FIG. 4, the fluid container is put upside down, and mounted again in the cleaning device so that it can be used again as shown in the left-most picture of FIG. 4.

FIG. 5 shows an alternative way of using a single fluid container for separately containing the cleaning fluid CF and the dirty fluid DF. In FIG. 5, the part for the cleaning fluid CF is separated from the part for the dirty fluid DF by a flexible bladder B, i.e. an elastic or at least flexible wall, which is capable of deforming depending on the amount of fluid/pressure on both sides of the bladder B. The 3 pictures in FIG. 5 show from left to right an initial situation in which the fluid container is just filled with cleaning fluid CF, an intermediate situation in which the fluid container contains both cleaning fluid CF and dirty fluid DF, separated by the bladder B, and a final situation in which the fluid container contains only dirty fluid DF.

Figure 6:
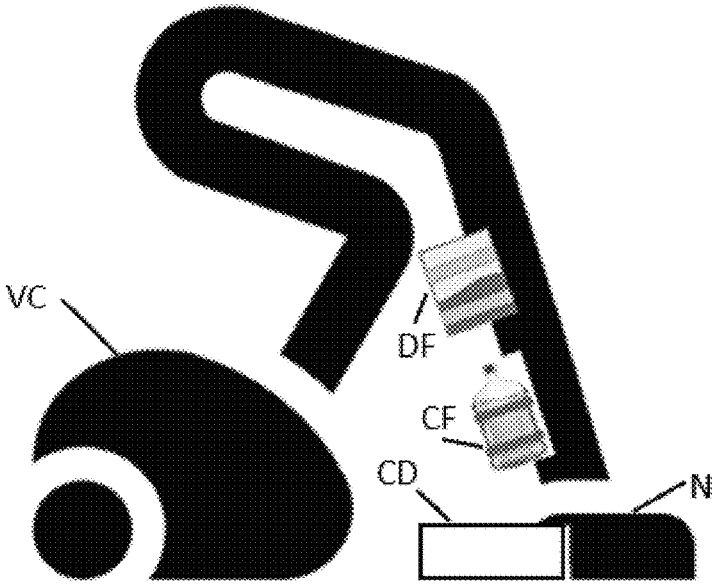
FIG. 6 shows an embodiment of a vacuum cleaner provided with a cleaning device in accordance with the invention.

FIG. 6 shows an embodiment of a vacuum cleaner VC provided with a cleaning device CD in accordance with the invention. The cleaning device CD may be as described above, and is attached to a nozzle N of the vacuum cleaner VC. Along the stick of the vacuum cleaner, containers for cleaning fluid CF and dirty fluid DF are mounted, together with any necessary pumps. While FIG. 5 suggests a combination with a canister-based vacuum cleaner VC, a combination with a robot vacuum cleaner is alternatively possible. In the latter case, as a robot vacuum cleaner usually only moves forward during a cleaning operation, rather than both backward and forward, it would suffice if the cleaning device is just provided with a single cleaning fluid channel and a single dirty fluid channel following the cleaning channel.

It should be noted that the above-mentioned embodiments illustrate rather than limit the invention, and that those skilled in the art will be able to design many alternative embodiments without departing from the scope of the appended claims. While a first application of the invention is in cleaning surfaces like floors or windows, an alternative application would be in wound treatment: the surface would then be the skin, and the cleaning fluid could then contain suitable wound treatment fluids including e.g. disinfectants and/or antibiotics. This could reduce the number of times the bandage has to be replaced, reducing the time to heal. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A cleaning device, comprising:

a triangular bottom with a first surface interaction layer and a second surface interaction layer, wherein an angle between the first surface interaction layer and the second surface interaction layer is such that only one of the first surface interaction layer and the second surface interaction layer is in contact with a surface during a first movement direction in a forward direction and a second movement direction in a rearward direction;

a cleaning fluid supply provided with at least one cleaning fluid channel for supplying a cleaning fluid to the surface; and a dirty fluid drain provided with at least one dirty fluid channel for draining, by means of underpressure, dirty fluid from the surface, wherein the at least one cleaning fluid channel is provided with a first cleaning fluid channel and a second cleaning fluid channel in parallel to the at least one dirty fluid channel, the first cleaning fluid channel and the second cleaning fluid channel not being in a same plane, whereby the cleaning device is arranged for in the first movement direction of the cleaning device, wetting the surface by the first cleaning fluid channel via an interaction between the surface and the first cleaning fluid channel through the first surface interaction layer being in contact with the surface and draining the surface by the at least one dirty fluid channel without the second cleaning fluid channel touching the surface, and in the second movement direction of the cleaning device, wetting the surface by the second cleaning fluid channel via an interaction between the surface and the second cleaning fluid channel through the second surface interaction layer being in contact with the surface and draining the surface by the at least one dirty fluid channel without the first cleaning fluid channel touching the surface.

2. The cleaning device as claimed in claim 1, wherein the first surface interaction layer is provided with the first cleaning fluid channel and the at least one dirty fluid channel, and the second surface interaction layer is provided with the second cleaning fluid channel and the at least one dirty fluid channel, with the first cleaning fluid channel, the second cleaning fluid channel, and the at least one dirty fluid channel not being all in the same plane, wherein the first surface interaction layer is arranged for cleaning the surface in the first movement direction, and the second surface interaction layer is arranged for cleaning the surface in the second movement direction.

3. The cleaning device as claimed in claim 1, wherein the at least one dirty fluid channel is provided with a first dirty fluid channel and a second dirty fluid channel in parallel to the first cleaning fluid channel and the second cleaning fluid channel.

4. The cleaning device as claimed in claim 1, wherein the cleaning fluid supply is provided with a cleaning fluid container for supplying the cleaning fluid to the first cleaning fluid channel and the second cleaning fluid channel.

5. The cleaning device as claimed in claim 1, wherein the dirty fluid drain is provided with a dirty fluid container, and a pressure difference applying device for transferring the dirty fluid from the surface to the dirty fluid container.

6. The cleaning device as claimed in claim 1, in which the first surface interaction layer and the second surface interaction layer are made of microfiber chamois, wherein the first surface interaction layer and the second surface interaction layer further comprise microfibers with a polyurethane coating.

7. The cleaning device as claimed in claim 6, wherein the first surface interaction layer and the second surface interaction layer comprise a fine microfiber and a coarse microfiber, wherein the fine microfiber is arranged for contacting the surface where the dirty fluid is drained from the surface, and the coarse microfiber is arranged for contacting the surface where the cleaning fluid is supplied to the surface.

8. The cleaning device as claimed in claim 7, wherein a coarse microfiber layer is between the dirty fluid drain and a fine microfiber layer arranged for contacting the surface, and wherein the fine microfiber layer is between the cleaning fluid supply and the coarse microfiber layer arranged for contacting the surface.

9. The cleaning device as claimed in claim 1, further comprising a single fluid container to supply the cleaning fluid and to collect the dirty fluid.

10. A vacuum cleaner provided with the cleaning device as claimed in claim 1.

11. The cleaning device as claimed in claim 1, in which the first surface interaction layer and the second surface interaction layer are made of natural chamois.

* * * * *